United States Patent [19]

Bills

[11] Patent Number: 4,931,608

[45] Date of Patent: Jun. 5, 1990

[54] MICROWAVE-HEATABLE HOT PAD

[75] Inventor: Randolph L. Bills, Riverbank, Calif.

[73] Assignee: Ran Free, Oakland, Calif.

[21] Appl. No.: 285,815

[22] Filed: Dec. 16, 1988

[51] Int. Cl.[5] ..... H05B 6/80

[52] U.S. Cl. ..... 219/10.55 F; 219/10.55 E; 219/10.55 M; 426/241; 99/DIG. 14

[58] Field of Search ..... 219/10.55 E, 10.55 F, 219/10.55 M, 10.55 R; 426/243, 241, 234; 99/DIG. 41, 451

[56] References Cited

U.S. PATENT DOCUMENTS

| | | | |
|---|---|---|---|
| 2,830,162 | 4/1958 | Copson et al. | 219/10.55 E |
| 3,701,872 | 10/1972 | Levinson | 219/10.55 E |
| 3,934,106 | 1/1976 | MacMaster et al. | 219/10.55 E |
| 3,946,188 | 3/1976 | Derby | 219/10.55 E |
| 4,210,124 | 7/1980 | Husslein et al. | 219/10.55 E X |
| 4,268,738 | 5/1981 | Flautt, Jr. et al. | 219/10.55 E |
| 4,272,663 | 6/1981 | Green | 219/10.55 E |
| 4,316,070 | 2/1982 | Prosise et al. | 219/10.55 E |
| 4,362,917 | 12/1982 | Freedman et al. | 219/10.55 E |
| 4,369,346 | 1/1983 | Hart et al. | 219/10.55 E |
| 4,539,454 | 9/1985 | Yangas | 219/10.55 F |
| 4,566,804 | 1/1986 | Collins et al. | 219/10.57 |
| 4,721,140 | 1/1988 | Coker | 219/10.55 E X |
| 4,743,726 | 5/1988 | Hughes et al. | 219/10.55 F |
| 4,748,308 | 5/1988 | Drews | 219/10.55 E |
| 4,866,231 | 9/1989 | Schneider | 219/10.55 F |

*Primary Examiner*—Philip H. Leung

*Attorney, Agent, or Firm*—Amster, Rothstein & Ebenstein

[57] ABSTRACT

A hot pad for absorbing energy in a microwave oven and heating articles in thermally conductive contact with the pad, comprises a flexible and conformable pad defining a plurality of individual flexible and conformable closed pockets. Each of the pockets is formed of a microwave-transmissive heat-resistant material and at least partially filled with microwave-absorbing particulate matter. The microwave-heated hot pad is used by being disposed in thermally conductive contact with an essentially microwave-transmissive article to be heated (e.g., a non-comestible).

13 Claims, 1 Drawing Sheet

FIG. 1
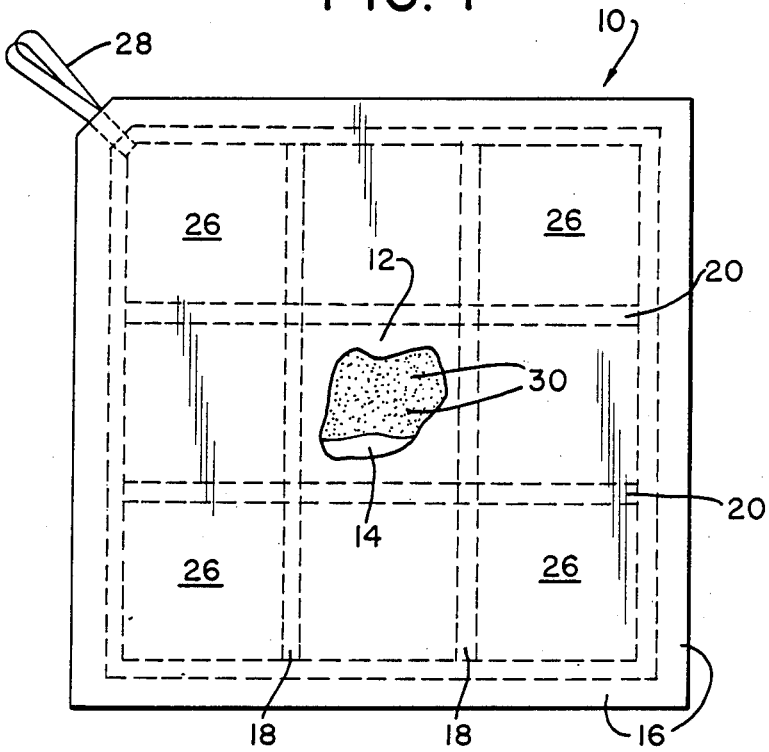
FIG. 2
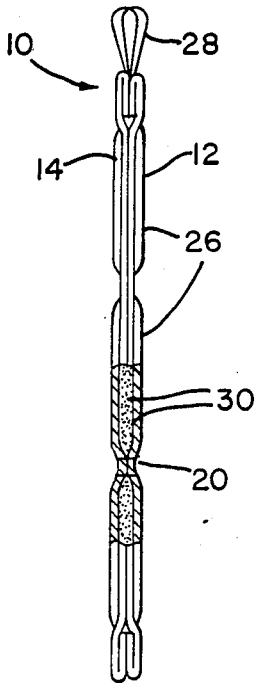
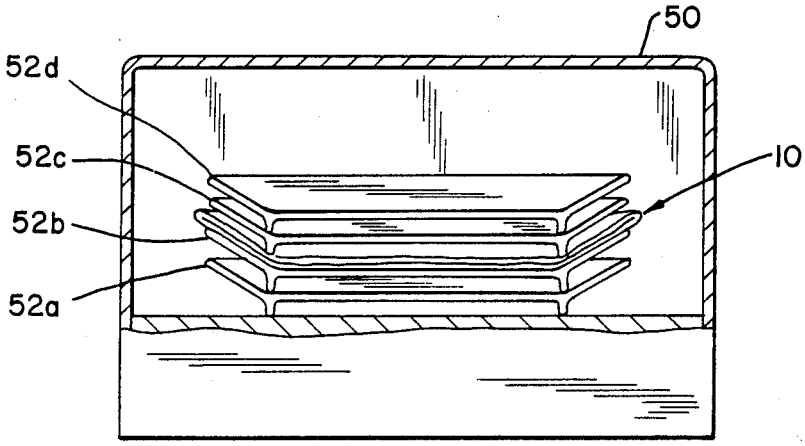
FIG. 3

MICROWAVE-HEATABLE HOT PAD

BACKGROUND OF THE INVENTION

The present invention relates to a hot pad for absorbing energy and heating articles, and more particularly to such a hot pad for absorbing energy in a microwave oven.

One of the many advantages of the use of a microwave oven is the ability to cook foodstuffs on a plate, with the plate remaining sufficiently cool that it may be manually removed from the oven without the use of thermally insulated gloves or handles. This "advantage" arises from the fact that typical plates (including dishes, platters and the like) are formed of microwave-transmissive material and are devoid of moisture which would absorb and become excited by the microwave energy so as to effect sensible heating of the plate. To the extent the plate heats up, such heating is due to heat transferred from the food on the plate. It is not possible to heat an empty plate or similar article in a microwave oven. A hot meal should be served on a warmed plate so that the meal remains hot (or at least warm) during the eating thereof. Unfortunately, as noted above, plates of microwave-transmissive material cannot presently be heated in a microwave oven. Thus, the need remains for means to enable such plates and other similar microwave-transmissive materials to be heated in a microwave oven.

Accordingly, it is an object of the present invention to provide a hot pad for absorbing energy in a microwave oven and heating articles (such as plates of microwave-transmissive material) in thermally conductive contact with the pad.

Another object is to provide a method of using such a hot pad to heat a microwave-transmissive article in a microwave oven.

A further object is to provide a method of using such a hot pad to heat an article outside of a microwave oven.

SUMMARY OF THE INVENTION

The above and related objects of the present invention are obtained in a hot pad for absorbing energy in a microwave oven and heating articles in thermally conductive contact with the pad. The hot pad comprises a flexible and conformable pad defining a plurality of individual flexible and conformable closed pockets. Each of the pockets is formed of a microwave-transmissive heat-resistant material and at least partially filled with microwave-absorbing particulate matter.

In a preferred embodiment, the microwave-transmissive material is a fabric, and the microwave-absorbing particulate matter is selected from the group consisting of aluminum oxide, ferrites and garnets. The particulate matter occupies only a portion of the total volume in each of the pockets, and the pad, intermediate the pockets, is flexible and conformable so that the pockets may be moved into different orientations relative to one another.

The thermally conductive contact is preferably direct physical contact.

The present invention further encompasses a method of heating a microwave-transmissive article in a microwave oven using the hot pad by placing it in thermally conductive contact with the article to be heated. The pad may be used to heat a plurality of such articles, the pad being placed above at least one of the articles to be heated and below at least one of the articles to be heated.

The present invention further encompasses a method of heating an article outside of a microwave oven using the hot pad by placing the pad in the microwave oven for a period of time sufficient for the microwave-absorbing particulate matter in the pad to absorb microwave energy and reach an elevated temperature, and then removing the pad from the microwave oven and placing it in thermally conductive contact with the article to be heated. Preferably the pad is conformed into at least partially encapsulating relationship with the article to be heated.

BRIEF DESCRIPTION OF THE DRAWING

The above brief description, as well as further objects and features of the present invention, will be more fully understood b reference to the following detailed description of the presently preferred, albeit illustrative, embodiments of the present invention when taken in conjunction with the accompanying drawing wherein:

FIG. 1 is a top plan view of a hot pad according to the present invention, with portions thereof removed to reveal details of internal construction;

FIG. 2 is a sectional view thereof taken along the line 2—2 of FIG. 1; and FIG. 3 is a front elevation view of the hot pad in use in a microwave oven.

DETAILED DESCRIPTION OF THE PREFERRED EMBODIMENTS

Referring now to the drawing, and in particular to FIGS. 1 and 2 thereof, therein illustrated is a hot pad according to the present invention, generally designated by the reference numeral 10. The hot pad 10 has two outer layers, an upper layer 12 and a lower layer 14. The upper and lower layers 12, 14 are sewn or otherwise secured together about the margin 16 of the pad 10 and in a gridwork composed of vertical columns 18 and horizontal rows 20 to define a plurality of individual closed pockets 26. If desired, to facilitate hanging of the hot pad 10 on a wall hook when it is not in use, a conventional loop 28 may be formed or added to the pad 10 at one corner thereof.

While the illustrated pad defines a $3\times3$ pattern of pockets 26, for a total of nine pockets, other arrangements are equally satisfactory, including a $4\times4$ pattern, for a total of sixteen pockets. Further, while the illustrated pad is approximately 8.5 by 8.5 inches square, larger or smaller hot pads may be used for particular applications and such hot pads need not be square, but may be rectangular, circular or of any other desired configuration.

Layers 12 and 14 may be formed of any conventional microwave-transmissive, heat-resistant material which, in the thickness used, will provide a flexible and conformable layer. A preferred material is a fabric such as cotton. Depending upon the nature of the material used to form the layers 12, 14 and the anticipated temperatures to which it will be exposed, the layers 12, 14 may be joined marginally and in a pocket-defining gridwork by sewing, adhesives, heat sealing or other conventional means for joining layers. For fabrics such as cotton, sewing is preferred.

As best seen in the upper left pocket 26 illustrated in FIG. 1, each of the closed pockets 26 is at least partially filled with a microwave-absorbing particulate matter 30. Any conventional microwave-absorbing particulate matter 30 may be used with aluminum oxide, ferrites, garnets being preferred, and aluminum oxide being especially preferred. If necessary, the matter may be pulverized to provide particulate matter of suitably small dimensions (about 1/16–⅛ inch in diameter or maximum dimension if not round). The particulate matter 30 occupies only a small fraction of the total volume in each of the pockets 26, typically forming a thin, somewhat irregular, not necessarily continuous layer within the Pocket. For an 8.5 ×8.5 inch hot pad 10 having nine pockets 26, about 0.5 teaspoon of the particulate matter 30 is preferably used. While each individual particle of the particulate matter 30 may be rigid and inflexible, the partially filled pocket 26 as a whole remains flexible and conformable due to the small size of the particles 30 and their ability to flow past one another within the pocket 26. Thus, not only is the pad 10 as a whole flexible and conformable, with each pocket 26 being movable relative to its adjacent pockets, but each pocket 26 itself is individually flexible and conformable. Thus, the pad 10 easily conforms to the upper surface of an article upon which it is placed and/or the lower surface of an article placed thereon, thereby to establish a good thermally conductive contact with the article or articles.

As one or both of the layers 12, 14 of the pad 10 may be in contact with a plate subsequently used for the service of food, the layers 12, 14 are formed of a heat-resistant material which will not leave any toxic residue upon the articles which they engage. While the microwave-absorbing particulate matter 30 need not be non-toxic if it is totally enclosed by the pockets 26, it is preferably inert and non-toxic to avoid contamination of a food product in the event that a pocket 26 becomes torn and the particulate matter 30 leaks therethrough onto an article on which food will later be served.

Referring now to FIG. 3, therein illustrated is a microwave oven generally designated 50, a stack of four plates 52 or other articles to be heated, and a pad 10 according to the present invention disposed intermediate the bottom two plates 52*a*, 52*b* and the top two plates 52*c*, 52*d*. The flexible and conformable nature of the pad 10 permits the upper surface of the second plate 52*b* and the lower surface of the third plate 52*c* to cause the adjacent surfaces 14, 12 of the pad 10 to conform generally to both adjacent plate surfaces to establish a physical, thermally conductive contact therewith. While the pad 10 is not in direct physical contact with the first and fourth plates 52*a*, 52*d* at the bottom and top of the stack, such first and fourth plates 52*a*, 52*d* are in direct physical and thermally conductive contact with the second and third plates 52*b*, 52*c*, respectively, so that the pad 10 is also in thermally conductive contact with the first and fourth plates 52*a*, 52*d*.

During operation of the microwave oven 50, the microwave energy within the interior will pass through the microwave-transmissive plates 52 and through the layers 12, 14 of the pad 10 to be absorbed by the particulate matter 30 within the pockets 26 of the pad. The particulate matter 30 absorbing the microwave energy will then heat up as the absorbed microwave energy is converted into sensible heat, and the plates 52 in thermally conductive contact with the pad 10 will in turn be heated by the dissipation of heat from particulate matter 30 through the layers 12, 14. Transmission of heat energy from the particulate matter 30 to the articles 52 to be heated is primarily through conduction, although convection may also contribute to the heat transfer, especially in connection with the articles 52 on top of the pad 10. For example, where the plate 52 has a large depending circular flange extending downwardly from the bottom thereof and contacting the pad 10, the transmission of heat from the pad 10 to the plate 52 will be primarily through conduction via the flange, but also partially through convection as the heat rises from the portion of the pad spaced directly below the plate base within the flange. As a result of the confined space defined by the pad upper surface, the plate base lower surface, and the laterally surrounding flange, the cumulative heating of the plate base may be substantial.

It will be appreciated that the pad 10 has a large surface area and thus dissipates heat relatively rapidly. Thus, once the microwave oven 50 is turned off, the pad is almost immediately safe to handle as long as the handler does not press tightly upon any of the pockets 26. In any event, the pad may be grasped by the loop 28 for immediate hanging on a wall hook. The plates 52 in thermally conductive contact with the pad 10, on the other hand, are heated by the pad more than is the handler's hand for one of two reasons. Either the plate has a large relatively planar surface area to which the pad can easily conform or the plate presents a relatively small surface area (such as the above-mentioned flange) to the pad so that the entire weight of the plate is concentrated in this small surface area. The first factor typically dominates where the pad is placed on the upper surface of a plate, and the second factor typically dominates where a plate with a downwardly extending flange is placed on the upper surface of the pad. The greater the pressure driving the pad and the plate together, the greater the heat transfer between the two articles, presumably because the particulate matter is better able to at least partially envelop the adjacent plate surface as the pad conforms thereto. Thus, the surface temperature of the plates being heated may be substantially higher than the apparent surface temperature of the pad when the pad is only lightly or briefly contacted by the handler.

Once a hot pad 10 has been heated within the microwave oven 50 (regardless of whether or not plates 52 are present in the oven), the heated hot pad 10 may be removed from the oven 50 and at least partially wrapped around a loaf of bread, a plate of rolls or other foodstuffs in order to heat or maintain warm the foodstuffs. The flexible nature of the pad 10 and the individual pockets 26 allows the pad to wrap around and at least partially encapsulate the article to be heated, thereby facilitating the attainment of a desirably efficient thermally conductive contact between the hot pad 10 and the foodstuffs to be heated or maintained warm and further permitting the hot pad 10 to physically seal off the foodstuffs from ambient cool air.

To summarize, the present invention provides a hot pad for absorbing energy in a microwave oven and heating articles in thermally conductive contact with the pad as well as methods of using the hot pad to heat articles within and outside of a microwave oven.

Now that the preferred embodiments of the present invention have been shown and described in detail, various modifications and improvements thereon will become readily apparent to those skilled in the art. Accordingly, the appended claims should be construed broadly and in a manner consistent with the spirit and scope of the invention herein.

I claim:

1. A substantially dry hot pad for absorbing energy in a microwave oven and heating an essentially microwave-transmissive non-comestible article in thermally conductive contact with the pad, comprising:

a flexible and conformable substantially dry pad defining a series of individual flexible and conformable closed pockets spaced from each other, each of said pockets being formed of a microwave-transmissive heat-resistive material and at least partially filled with microwave-absorbing particulate matter, said pad being capable of heating an essentially microwave-transmissive non-comestible article in thermally conductive contact therewith in a microwave oven and being flexible and conformable even at room temperature.

2. The hot pad of claim 1 wherein said material is a fabric.

3. The hot pad of claim 1 wherein said microwave-absorbing particulate matter is selected from the group consisting of aluminum oxide, ferrites and garnets.

4. The hot pad of claim 1 wherein said particulate matter occupies only a portion of the total volume in each of said pockets.

5. In combination, the hot pad of claim 1 and an essentially microwave-transmissive non-comestible article wherein said thermally conductive contact is direct physical contact.

6. The hot pad of claim 1 wherein portions of said pad intermediate said pockets are flexible and conformable so that said pockets may be moved relative to one another.

7. In combination, the hot pad of claim 6 and an essentially microwave-transmissive non-comestible article wherein said thermally conductive contact is direct physical contact.

8. The hot pad of claim 1 wherein said material is liquid-permeable.

9. The method of heating an essentially microwave-transmissive non-comestible article in a microwave oven comprising the steps of:

(A) providing a flexible and conformable substantially dry pad defining a series of individual flexible and conformable closed pockets, each of said pockets being formed of a microwave-transmissive heat-resistant material and at least partially filled with microwave-absorbing particulate matter, said pad being capable of heating an essentially microwave-transmissive non-comestible article in thermally conductive contact therewith in a microwave oven and being flexible and conformable even at room temperature;

(B) placing said pad in thermally conductive contact with the article to be heated; and (C) placing said pad and the article in a microwave oven for heating.

10. The method of claim 9 wherein said pad is used to heat a plurality of articles and is placed above at least one of the articles to be heated and below at least one of the articles to be heated.

11. A method of heating an essentially microwave-transmissive article outside of a microwave oven comprising the steps of:

(A) providing a flexible and conformable substantially dry pad defining a series of individual flexible and conformable closed pockets, each of said pockets being formed of a microwave-transmissive heat-resistant material and at least partially filled with microwave-absorbing particulate matter;

(B) placing the pad in the microwave oven for a period of time sufficient for the matter in the pad to absorb microwave energy and reach an elevated temperature; and (C) removing the pad from the microwave oven and placing it in thermally conductive contact with the article to be heated.

12. The method of claim 11 wherein in step (C) the pad is conformed into at least partially encapsulating relationship with the article to be heated.

13. The hot pad of claim 11 wherein said essentially microwave-transmissive article is a non-comestible.

* * * * *